United States Patent [19]

Guaraldi et al.

[11] Patent Number: 5,027,705

[45] Date of Patent: Jul. 2, 1991

[54] APPARATUS FOR PREVENTING UNDESIRED FLUID FLOW PAST A FLOW CONTROL LOCATION

[75] Inventors: Glenn A. Guaraldi, Kingston; Michael Skowron, Dover, both of N.H.

[73] Assignees: Harris Graphics Corporation, Dover, N.H.; Harris Graphics Corporation, Dover, N.H.

[21] Appl. No.: 569,529

[22] Filed: Aug. 17, 1990

Related U.S. Application Data

[63] Continuation of Ser. No. 289,612, Dec. 23, 1988, abandoned.

[51] Int. Cl.[5] ..... B41F 7/26; B41F 7/32; B41F 7/40; B41L 23/18

[52] U.S. Cl. ..... 101/148

[58] Field of Search ..... 101/147, 148, 207–210, 101/349, 350–352, 356, 360, 361, 363, 364

[56] References Cited

U.S. PATENT DOCUMENTS

| | | | |
|---|---|---|---|
| 2,275,514 | 3/1942 | Dudley | 101/363 |
| 3,627,557 | 12/1971 | Sato et al. | 118/262 |
| 3,688,694 | 9/1972 | Preuss | 101/148 |

*Primary Examiner*—J. Reed Fisher

*Attorney, Agent, or Firm*—Tarolli, Sundheim & Covell; Tarolli, Sundheim & Covell

[57] ABSTRACT

An apparatus is disclosed for controlling fluid flow at a flow control location between first and second rollers. Each roller is rotatable about its longitudinal central axis. The two rollers are disposed adjacent to each other so as to form a flow control location or nip between the rollers. The nip has an entrance side and an exit side. As the rollers rotate, fluid from a fluid pan is carried on the outer surface of the first roller to the entrance side of the nip. Some of the fluid at the nip is transferred onto the outer surface of the second roller. As the rollers continue to rotate, the fluid flows out of the nip at the exit side of the nip. An excess fluid condition occurs at the nip when the amount of fluid flow to the entrance side of the nip exceeds the amount of fluid flow from the exit side of the nip. A brass collar is connected at one end of the first roller. Another brass collar is connected at the outer end of the first roller. The two brass collars rotate with the first roller and cooperate to prevent excess fluid at the entrance side of the nip from flowing around the opposite axial ends of the nip onto the second roller. This is accomplished by the two brass collars picking up excess fluid at the entrance side of the nip and subsequently transferring the excess fluid back to the fluid pan.

7 Claims, 1 Drawing Sheet

APPARATUS FOR PREVENTING UNDESIRED FLUID FLOW PAST A FLOW CONTROL LOCATION

This is a continuation of co-pending application Ser. No. 07/289,612 filed on Dec. 23, 1988, now abandoned.

BACKGROUND OF THE INVENTION

1. Technical Field

The present invention relates to controlling fluid flow at a flow control location, and is particularly directed to an apparatus for preventing undesired fluid flow past a flow control location defined by a nip formed by a pair of rollers. The apparatus of the present invention is especially applicable to a dampening system of a printing press.

2. Background Art

A dampening system for a printing press typically includes a plurality of rollers for transferring dampening fluid to a printing plate during operation of the printing press. The printing plate is secured to a plate cylinder of the printing press. One of the plurality of rollers is a pan roller rotatable about its longitudinal central axis. Another one of the plurality of rollers is a slip roller rotatable about its longitudinal central axis and located adjacent to the pan roller. A nip is formed between the two rollers along the axial extent of the two rollers. The nip has a fluid entrance side at which fluid enters the nip and a fluid exit side from which fluid flows from the nip.

During operation of the printing press, the pan roller rotates about its longitudinal central axis in one direction while the slip roller rotates about its longitudinal central axis in the opposite direction. Thus, at the nip between the two rollers, the pan and slip rollers rotate in the same direction. The pan roller is partially immersed in a supply of dampening fluid, and the dampening fluid adheres to the outer surface of the pan roller as the pan roller rotates. The fluid is carried on the outer surface of the pan roller to the entrance side of the nip. Thus, the fluid enters the nip between the two rollers.

When the dampening fluid carried on the outer surface of the pan roller enters the nip between the two rollers, some of the fluid is transferred onto the outer surface of the slip roller. The fluid not transferred onto the outer surface of the slip roller remains adhered to the outer surface of the pan roller. The fluid adhering to the outer surface of the slip roller is subsequently transferred by other rollers onto the outer surface of the printing plate. The fluid which remains adhered to the outer surface of the pan roller is carried back to the supply of dampening fluid.

As known in the art, it is desirable to control the amount of fluid transferred to the outer surface of the printing plate. One way to control the amount of fluid transferred to the printing plate is to control the rotational speed of the pan roller and the rotational speed of the slip roller. An increase in the speed of each of the rollers increases the amount of fluid transferred to the printing plate. Likewise, a decrease in speed of each of the rollers decreases the amount of fluid transferred to the printing plate. Another way to control the amount of fluid transferred to the printing plate is to skew one of the two rollers along the axial extent of the two rollers. Still another way is to increase or decrease the pressure between the two rollers at the nip. Thus, the nip is a flow control location in the dampening system.

If the amount of fluid carried on the outer surface of the pan roller to the entrance side of the nip exceeds the amount of fluid flowing out of the nip at the exit side of the nip, a buildup of excess fluid at the entrance side of the nip occurs. The excess fluid at the entrance side of the nip tends to flow to the opposite axial ends of the nip. Although some of the excess fluid drips from the opposite axial ends of the pan roller back into the fluid pan due to gravity, some of the excess fluid may flow around the opposite axial ends of the nip (the flow control location) and onto the slip roller. Some of the fluid transferred onto the slip roller in this manner is subsequently transferred to the printing plate. This fluid flow around the opposite axial ends of the nip onto the slip roller is undesirable because such flow is uncontrolled and unintended.

SUMMARY OF THE INVENTION

The present invention provides an apparatus for controlling fluid flow at a flow control location between two rollers. The apparatus includes means connected at the opposite axial ends of one of the rollers for preventing undesired fluid flow past the flow control location. The apparatus of the present invention is particularly suitable for use in a dampening system of a printing press.

In a preferred embodiment of the present invention, the apparatus includes a pan roller having a collar fixedly connected at each of the opposite axial ends of the pan roller. The pan roller is partially immersed in a fluid pan filled with dampening fluid. The pan roller is disposed adjacent to a slip roller to form a nip between the pan roller and the slip roller. The nip has an entrance side and an exit side and extends along the axial direction of the pan and slip rollers. The slip roller is disposed adjacent to a vibrator roller which, in turn, is disposed adjacent to a form roller. The form roller is disposed adjacent to a printing plate secured to a plate cylinder of a printing press. The rollers are rotatable about their longitudinal central axes.

The pan roller is rotated about its longitudinal central axis to carry fluid on its outer surface from the fluid pan to the entrance side of the nip. The fluid at the nip is either transferred onto the outer surface of the slip roller or remains adhered to the outer surface of the pa roller. The fluid on the outer surface of the pan roller is carried back into the fluid pan. The fluid transferred onto the outer surface of the slip roller is subsequently transferred to the printing plate.

In the event of an excess fluid condition at the entrance side of the nip, the excess fluid tends to flow to the opposite axial ends of the nip. When the excess fluid reaches the ends of the nip, some of this fluid drips back into the fluid pan due to gravity. In accordance with the present invention, some of the excess fluid is prevented from flowing around the opposite axial ends of the nip onto the slip roller by the collars at the opposite axial ends of the pan roller. The two collars rotate with the pan roller about the longitudinal central axis of the pan roller. Thus, the two collars pick up excess fluid at the opposite axial ends of the nip and move the excess fluid away from the slip roller. This fluid is transferred back into the fluid pan by rotation of the collars with the pan roller. By preventing the excess fluid at the entrance of the nip from flowing around the opposite axial ends of the nip onto the slip roller, accurate control of the amount of fluid transferred to the printing plate is maintained.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

The present invention relates to a fluid flow control apparatus for preventing undesired transfer of a fluid past a flow control location. The application and construction of the apparatus of the present invention may vary. The apparatus of the present invention is particularly suitable for use in a dampening system of a printing press and will be described herein as applied thereto.

Figure 1:
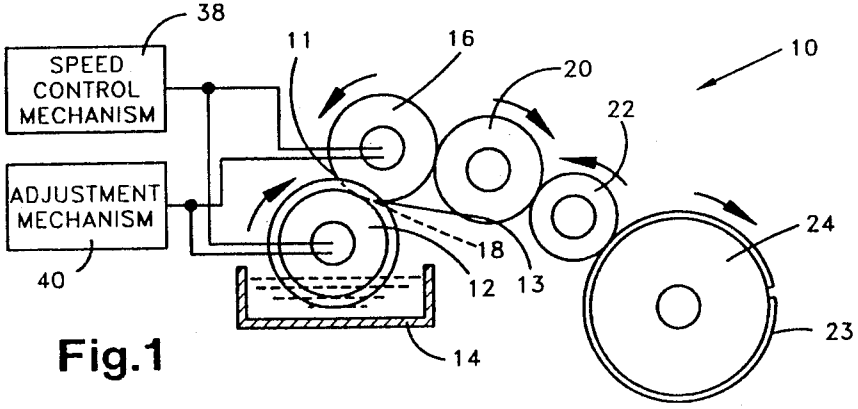
FIG. 1 is a schematic illustration of a dampening system for a printing press and constructed in accordance with the present invention.

A dampening system for use in a printing press, constructed in accordance with the present invention, is illustrated in FIG. 1. The dampening system 10 includes a pan roller 12 partially immersed in a fluid pan 14 filled with a dampening solution. A typical dampening solution includes water, alcohol, and gum arabic.

Referring to FIGS. 1 through 4, the pan roller 12 is rotatable about its longitudinal central axis 25 and has a cylindrical outer surface. The longitudinal central axis 25 of the pan roller 12 lies on a vertical line 19. The outer surface of the pan roller 12 as is conventional is made of a chrome material. The pan roller 12 is located adjacent to a slip roller 16. The slip roller 16 is rotatable about its longitudinal central axis 27 and has a cylindrical outer surface. A line 21 extends through the longitudinal central axis 27 of the slip roller 16 and the longitudinal central axis 25 of the pan roller 12. The position of the slip roller 16 relative to the position of the pan roller 12 is such that the lines 19 and 21 intersect to form a predetermined angle therebetween. The outer surface of the slip roller 16 as is conventional is made of a rubber material.

A nip 18 is formed between the pan roller 12 and the slip roller 16 along the axial extent of the two rollers 12, 16. The nip 18 has a fluid entrance side 11 and a fluid exit side 13. The entrance side 11 of the nip 18 and the exit side 13 of the nip 18 are located on opposite sides of the line 21. One side of the line 21 is at a higher elevation than the other side of the line 21. The entrance side 11 of the nip 18 is on the side of the line 21 at the higher elevation. The exit side 13 of the nip is on the side of the line 21 at the lower elevation.

The slip roller 16 is located adjacent to a vibrator roller 20. The vibrator roller 20, in turn, is located adjacent to a form roller 22. The vibrator roller 20 and the form roller 22 have cylindrical outer surfaces and are rotatable about their respective longitudinal central axes. The form roller 22 is disposed adjacent to a printing plate 23 secured to a printing plate cylinder 24 of the printing press.

Figure 2:
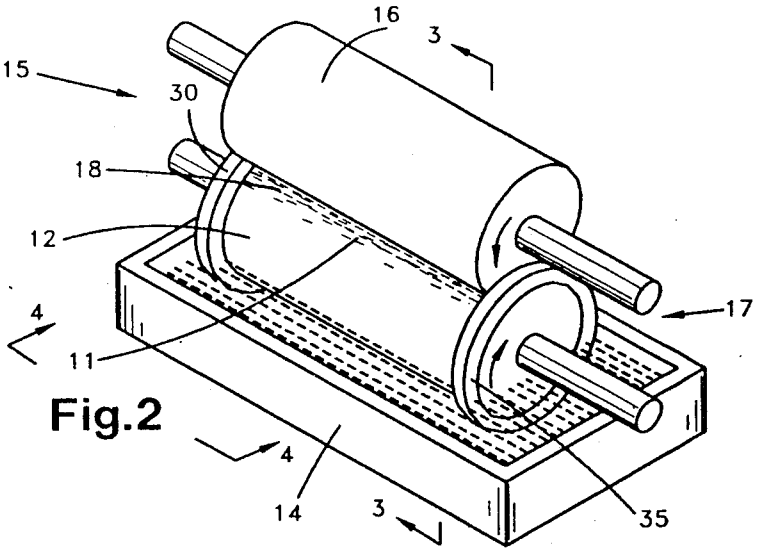
FIG. 2 is a schematic perspective view of a portion of the dampening system shown in FIG. 1 illustrating the relationship between two rollers and a flow control location between the two rollers.
Figure 3:
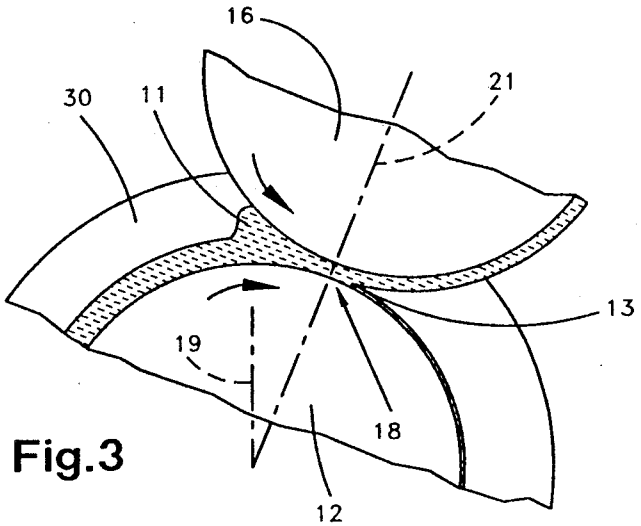
FIG. 3 is an enlarged, partial schematic illustration of FIG. 2 taken approximately along line 3—3 of FIG. 2 illustrating the manner in which dampening fluid is transferred from one roller to the other roller.

During operation of the printing press, the pan roller 12 rotates about its longitudinal central axis 25 in one direction, while the slip roller 16 rotates about its longitudinal central axis 27 in the opposite direction. As shown in FIGS. 1, 2 and 3, the pan roller 12 is rotating in the clockwise direction and the slip roller 16 is rotating in the counterclockwise direction. Thus, the pan and slip rollers 12, 16 rotate in the same direction at the nip 18 between the pan roller 12 and the slip roller 16. Since the pan roller 12 is partially immersed in the fluid pan 14, the dampening fluid in the fluid pan 14 adheres to the outer surface of the pan roller 12 as the pan roller 12 rotates about its longitudinal central axis 25. The fluid adheres to the outer surface of the pan roller 12 because of the affinity between the fluid and the chrome outer surface of the pan roller 12.

Figure 4:
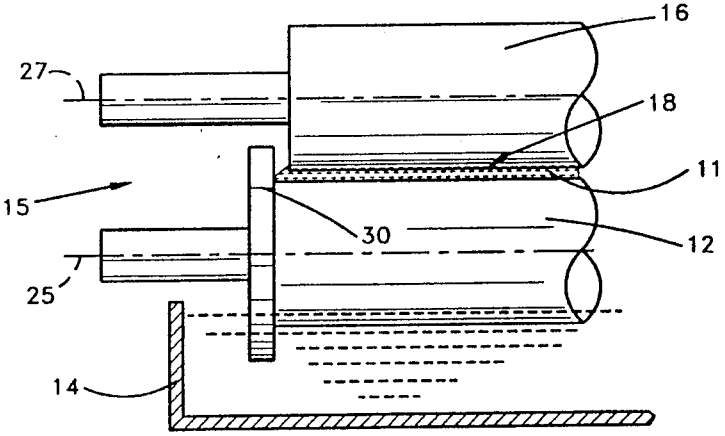
FIG. 4 is an enlarged, side view of FIG. 2 taken approximately along line 4—4 of FIG. 2 further illustrating the relationship between the two rollers and the flow control location between the two rollers.

Referring to FIGS. 3 and 4, the fluid is carried on the outer surface of the pan roller 12 from the fluid pan 14 to the entrance side 11 of the nip 18 between the pan roller 12 and the slip roller 16. The fluid at the entrance side 11 of the nip 18 moves through the nip 18 to the exit side 13 of the nip 18 as the two rollers 12, 16 continue to rotate about their longitudinal central axes 25, 27. Since the entrance side 11 of the nip 18 is at a higher elevation than the exit side 13 of the nip 18, gravity assists in the movement of the fluid through the nip 18.

As the fluid moves through the nip 18 to the exit side 13 of the nip 18, some of the fluid is transferred from the outer surface of the pan roller 12 onto the outer surface of the slip roller 16. This transfer occurs because the affinity between the fluid and the rubber outer surface of the slip roller 16 is greater than the affinity between the fluid and the chrome outer surface of the pan roller 12. The fluid not transferred onto the outer surface of the slip roller 16 remains adhered to the outer surface of the pan roller 12. The fluid which remains adhered to the outer surface of the pan roller 12 is carried back to the fluid pan 14.

Referring to FIGS. 1 and 4, as the slip roller 16 continues to rotate about its longitudinal central axis 27, the fluid carried on the outer surface of the slip roller 16 is transferred onto the outer surface of the vibrator roller 20. The vibrator roller 20, in turn, transfers the fluid on its outer surface to the outer surface of the form roller 22. In the same manner, the fluid carried on the outer surface of the form roller 22 is transferred onto the outer surface of the printing plate 23. Thus, the pan roller 12, the slip roller 16, the vibrator roller 20, and the form roller 22 of the dampening system 10 cooperate together to transfer fluid from the fluid pan 14 to the outer surface of the printing plate 23 secured to the plate cylinder 24 of the printing press.

The amount of fluid transferred from the fluid pan 14 to the printing plate 23 can be varied. One way to vary the amount of fluid transferred from the fluid pan 14 to the printing plate 23 is to change the rotational speed of either the pan roller 12 or the slip roller 16. A speed control mechanism 38, as known in the art, for varying the rotational speed of either the pan roller 12 or the slip roller 16 is operatively connected to the two rollers 12, 16 as schematically illustrated in FIG. 1. The speed control mechanism 38 can be one of a multitude of conventional designs. Thus, details of its construction will not be discussed. An increase in the speed of either of the two rollers 12, 16 increases the amount of fluid transferred to the printing plate 23. A decrease in the speed of either of the two rollers 12, 16 decreases the amount of fluid transferred to the printing plate 23.

Another way to control the amount of fluid transferred from the fluid pan 14 to the printing plate 23 is to skew the pan roller 12 relative to the slip roller 16 along the axial extent of the two rollers 12, 16. When the two rollers 12, 16 are skewed, the contact pressure between the two rollers 12, 16 changes. An increase in the contact pressure between the two rollers 12, 16 decreases the amount of fluid transferred from the fluid pan 14 to the printing plate 23. A decrease in the contact pressure, up to a certain point, increases the amount of fluid transferred from the fluid pan 14 to the printing plate 23.

The amount of fluid transferred from the fluid pan 14 to the printing plate 23 can also be controlled by varying the size of the nip 18 between the pan roller 12 and the slip roller 16. The contact pressure between the two rollers 12, 16 varies as a function of the size of the nip 18 between the two rollers 12, 16. The amount of fluid transferred from the pan roller 12 to the slip roller 16 varies as a function of the contact pressure between the two rollers 12, 16 in the manner as described hereinabove. An adjustment mechanism 40, as known in the art, for adjusting the size of the contact area between the pan roller 12 and the slip roller 16 is operatively connected to the two rollers 12, 16 as schematically illustrated in FIG. 1. The adjustment mechanism 40 can be one of a multitude of conventional designs. Thus, details of its construction will not be discussed.

The fluid in the nip 18 is either transferred onto the outer surface of the slip roller 16 or remains adhered to the outer surface of the slip roller 16 as the two rollers 12, 16 continue to rotate about their longitudinal central axes 25, 27. The amount of fluid flowing out of the nip 18 at the exit side 13 of the nip 18 is the sum of the amount of fluid on the outer surface of the pan roller 12 and the amount of fluid on the outer surface of the slip roller 16. A buildup of excess fluid at the entrance side 11 of the nip 18 occurs if the amount of fluid transferred from the fluid pan 14 to the entrance side 11 of the nip 18 exceeds the amount of fluid flowing out of the nip 18 at the exit side 13 of the nip 18.

If an excess fluid condition occurs, the excess fluid which builds up at the entrance side 11 of the nip 18 tends to flow to the opposite axial ends of the nip 18. Most of the excess fluid flowing to the opposite axial ends of the nip 18 eventually flows off the opposite axial ends of the pan roller 12 back into the fluid pan 14. Some of the excess fluid at the opposite axial ends of the nip 18 tends to flow around the opposite axial ends of the nip 18 onto the slip roller 16. This tendency occurs because of the greater affinity between the fluid and rubber outer surface of the slip roller 16 relative to the affinity between the fluid and chrome outer surface of the pan roller 12, and the flow characteristics of the dampening solution.

The flow of excess fluid at the entrance side 11 of the nip 18 around the opposite axial ends of the nip 18 onto the slip roller 16 is undesirable. Such flow is undesirable because of its uncontrolled nature and its adverse effect on the accurate control of the amount of fluid transferred to the printing plate 23. One way to prevent this undesirable flow is to pick up the excess fluid at the opposite axial ends of the nip 18 and move the excess fluid away from the slip roller 16.

Referring to FIGS. 2, 3 and 4, a collar 30 is secured to the pan roller 12 at one end 15 of the pan roller 12. The collar 30 is made of a brass material. The brass collar 30 has a shape like a ring with an outer diameter greater than the outer diameter of the pan roller 12. The brass collar 30 is made of two separate pieces. Each piece has a semi-circular shape and forms one-half of the brass collar 30. The two pieces are held together by suitable fasteners. When the fasteners are tightened to hold the two pieces together, the brass collar 30 is fixedly secured to the pan roller 12. As shown in FIG. 2, a brass collar 35 identical to the brass collar 30 is fixedly secured to the pan roller 12 at the other end 17 of the pan roller 12.

The two brass collars 30, 35 located at the two opposite axial ends 15, 17, respectively, of the pan roller 12 are used to pick up the excess fluid at the opposite axial ends of the nip 18. Since the function of each of the brass collars 30, 35 is identical to the other collar, only the brass collar 30 at the one end 15 of the pan roller 12 will be described in detail. The affinity between the fluid and the brass collar 30 located at the end 15 of the pan roller 12 is greater than the affinity between the fluid and the rubber outer surface of the slip roller 16. This greater affinity between the fluid and the brass collar 30 tends to pick up the excess fluid at the end nip 18 as the brass collar 30 rotates with the pan roller 12. As the brass collar 30 continues to rotate with the pan roller 12, the fluid picked up by the brass collar 30 moves away from the slip roller 16 and back to the fluid pan 14. Thus, the excess fluid at the end of the nip 18 is picked up and moved away from the slip roller 16. By preventing the excess fluid at the end 15 of the nip 18 from flowing onto the slip roller 16 in this manner, accurate control of the amount of fluid transferred to the printing plate 23 is maintained.

The preferred embodiment described hereinbefore includes the pair of collars 30, 35 in which the collars are disposed at the opposite axial ends 15, 17 of the pan roller 12. However, it is contemplated that the two collars 30, 35 could instead be disposed at the opposite axial ends of the slip roller 16. Furthermore, it is conceivable that only one collar be used instead of two collars. Thus, if one collar is used, the collar would be disposed at one end of either the pan roller 12 or the slip roller 16.

This invention has been described above with reference to a preferred embodiment. Modifications and alterations may become apparent to one skilled in the art upon reading and understanding this specification. It is intended to include all such modifications and alterations within the scope of the appended claims.

Having described a preferred embodiment of the invention, I claim:

1. An apparatus for use in applying a dampening fluid to a printing plate which receives ink and dampening fluid comprising:

means defining a reservoir for containing a body of dampening fluid, the body of dampening fluid contained in said reservoir having an upper surface and opposite sides;

a first roller rotatable about its longitudinal central axis and having an outer cylindrical surface partially located in the body of dampening fluid for picking up dampening fluid as said first roller rotates about its longitudinal central axis;

a second roller rotatable about its longitudinal central axis and having an outer cylindrical surface, the outer cylindrical surface of said second roller and the outer cylindrical surface of said first roller defining a nip between said first and second rollers, dampening fluid being transferable at said nip from the outer cylindrical surface of said first roller to the outer cylindrical surface of said second roller;

said nip having an entrance side at which said first roller carries dampening fluid to said nip and an exit side at which said first and second rollers carry dampening fluid away from said nip, an excess fluid condition being formed at the entrance side of said nip if the amount of dampening fluid carried to said nip by said first roller exceeds the amount of dampening fluid said first and second rollers carry away from said nip;

means disposed on said first roller for transferring excess dampening fluid from the entrance side of said nip back to said reservoir and to thereby prevent flow of excess dampening fluid at the entrance side of said nip around said nip to the exit side of said nip, said means consisting only of a pair of collars, a first collar of said pair of collars being disposed at one end of said nip and on said first roller and a second collar of said pair of collars being disposed at the other end of said nip and on said first roller, each of said collars being rotatable with said first roller; and each of said collars having a pair of radially extending side surfaces and a peripheral cylindrical surface extending between said radially extending side surfaces, said peripheral cylindrical surface of each collar being coaxial with the outer cylindrical surface of said first roller, a part of each collar including part of said radially extending side surfaces and part of said peripheral cylindrical surface of each collar being above the upper surface of the body of dampening fluid and a part of each collar including part of said radially extending side surfaces and part of said peripheral cylindrical surface of each collar being immersed into the body of dampening fluid and beneath the upper surface of the body of the dampening fluid and being spaced from the opposite sides of the body of dampening fluid, the part of said radially extending side surfaces and the part of said peripheral cylindrical surface of each collar above the upper surface of the body of dampening fluid rotating into the body of dampening fluid to be immersed therein and the part of said radially extending side surfaces and the part of said peripheral cylindrical surface below the upper surface of the body of dampening fluid rotating out of the body of dampening fluid as said first roller with said pair of collars thereon rotates about the longitudinal central axis of said first roller, the part of each collar located above the upper surface of the body of dampening fluid carrying excess dampening fluid from the entrance side of said nip into the body of dampening fluid as said first roller with said pair of collars thereon rotates about the longitudinal central axis of said first roller.

2. The apparatus of claim 1 further including means operatively connected with said first and second rollers for controlling the rotational speed of said first roller about its longitudinal central axis and the rotational speed of said second roller about its longitudinal central axis.

3. The apparatus of claim 1 further including means operatively connected with said first and second rollers for adjusting the contact pressure at said nip between said first and second rollers.

4. The apparatus of claim 1 wherein a first line extends vertically and perpendicularly through the longitudinal central axis of said first roller and a second line extends perpendicularly through the longitudinal central axis of said first roller and the longitudinal central axis of said second roller, the first and second lines intersecting to form a predetermined angle therebetween, the entrance side and the exit side of said nip being disposed on opposite sides of the second axis, the entrance side of said nip being located on one side of the second line and within the predetermined angle formed between the first and second lines, the exit side of said nip being located on the opposite side of the second line and at an elevation lower than the elevation of the entrance side of said nip.

5. The apparatus of claim 1 wherein the diameter of the outer cylindrical surface of each of said collars is greater than the outer diameter of said first roller on which said collars are disposed.

6. The apparatus of claim 1 wherein each of said collars is made of brass.

7. The apparatus of claim 1 wherein said first collar is spaced apart from one end of said second roller and said second collar is spaced apart from the other end of said second roller.

* * * * *